US006585257B2

(12) United States Patent
DaCunha et al.

(10) Patent No.: US 6,585,257 B2
(45) Date of Patent: Jul. 1, 2003

(54) SHEET FEEDER WITH COUNTERACTING FORCES

(75) Inventors: Steven J. DaCunha, West Hartford, CT (US); Carlos DeFigueiredo, Sandy Hook, CT (US); John J. Mercede, Jr., Easton, CT (US); Joseph Vasallo, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 95 days.

(21) Appl. No.: 09/824,326

(22) Filed: Apr. 3, 2001

(65) Prior Publication Data

US 2002/0158402 A1 Oct. 31, 2002

(51) Int. Cl.[7] ..... B65H 1/24
(52) U.S. Cl. ..... 271/166; 271/165; 271/134
(58) Field of Search ..... 271/166, 165, 271/134

(56) References Cited

U.S. PATENT DOCUMENTS

| | | | | | |
|---|---|---|---|---|---|
| 1,433,911 | A | * | 10/1922 | Ritchie et al. | 271/126 |
| 1,513,254 | A | | 10/1924 | Lovercheck | |
| 1,957,318 | A | * | 5/1934 | Bush | 271/166 |
| 2,390,573 | A | * | 12/1945 | Dohl et al. | 271/166 |
| 3,285,605 | A | * | 11/1966 | Vasse | 271/166 |
| 3,503,606 | A | * | 3/1970 | Castellanet | 271/166 |
| 3,578,313 | A | | 5/1971 | Eppinger | 271/41 |
| 3,767,189 | A | * | 10/1973 | Kopp | 271/145 |
| 3,947,017 | A | * | 3/1976 | Seragnoli | 271/165 |
| 4,010,944 | A | | 3/1977 | Young | 271/99 |
| 4,093,207 | A | * | 6/1978 | Greenwell et al. | 271/100 |
| 4,177,979 | A | | 12/1979 | Orsinger et al. | 270/54 |
| 4,179,113 | A | * | 12/1979 | Gallimore | 271/12 |
| 4,666,140 | A | | 5/1987 | Godlewski | 271/35 |
| 4,715,593 | A | | 12/1987 | Godlewski | 271/10 |
| RE33,847 | E | | 3/1992 | DiBlasio | 271/3 |
| 5,110,107 | A | | 5/1992 | Bieber | 271/35 |
| 5,222,720 | A | * | 6/1993 | Newsome | 270/58.34 |
| 5,244,198 | A | | 9/1993 | Green | 271/125 |
| 5,294,102 | A | | 3/1994 | Ifkovits, Jr. et al. | 271/35 |
| 5,454,554 | A | | 10/1995 | Boughton et al. | 271/9.01 |
| 5,601,282 | A | | 2/1997 | Milo et al. | 271/35 |
| 6,050,563 | A | * | 4/2000 | Vedoy et al. | 271/10.04 |
| 6,053,492 | A | * | 4/2000 | Newsome | 271/105 |
| 6,416,047 | B1 | * | 7/2002 | Pfankuch | 271/165 |

FOREIGN PATENT DOCUMENTS

| | | | | |
|---|---|---|---|---|
| DE | 3622797 | A1 | * 4/1988 | B64H/31/08 |

* cited by examiner

*Primary Examiner*—Donald P. Walsh
*Assistant Examiner*—Jonathan R. Miller
(74) *Attorney, Agent, or Firm*—Michael J. Cummings; Charles R. Malandra, Jr.; Angelo N. Chaclas

(57) ABSTRACT

A method and apparatus for reducing burden in retrieving sheets of material from the bottom of a substantially vertical stack of sheets in a sheet feeder. The apparatus comprises a first convex surface at the bottom half of the stack protruding into one side of the stack for pushing the sheets toward the other side, and a second convex surface on the second side below the first convex surface for pushing the sheets toward the first side. The first and second convex surfaces each provide a counteracting force resisting the downward movement of the stack, and these countering forces have upward vertical components partially countering the downward vertical force due to the weight of the stack.

12 Claims, 7 Drawing Sheets

SHEET FEEDER WITH COUNTERACTING FORCES

FIELD OF THE INVENTION

The present invention generally relates to a sheet feeder, which can be used in an envelope inserting machine or the like, and, more particularly, to a sheet feeder for feeding sheets from a vertical stack.

BACKGROUND OF THE INVENTION

In an inserting machine for mass mailing, there is a gathering section where enclosure material is gathered before it is inserted into an envelope at an envelope insertion area. The gathering section is sometimes referred to as a chassis subsystem, which includes a gathering transport with pusher fingers rigidly attached to a conveyor belt and a plurality of enclosure feeders mounted above the transport. If the enclosure material contains many documents, these documents must be separately fed from different enclosure feeders.

Inserting machines are well-known. For example, U.S. Pat. No. 4,501,417 (Foster et al.) discloses an inserter feeder assembly for feeding enclosures; U.S. Pat. No. 4,753,429 (Irvine et al.) discloses a collating station; and U.S. Pat. No. 5,660,030 (Auerbach et al.) discloses an envelope inserter station, wherein envelopes are separately provided to an envelope supporting deck where envelopes are spread open so as to allow enclosure materials to be stuffed into the envelopes.

An exemplar inserting machine is shown in FIG. 1. As shown, an inserting machine 10 typically includes an envelope feeder/inserter station 12 and a plurality of enclosure feeders 20. The envelope feeder/inserter station 12 includes an envelope feeder 14 above an envelope insertion area 16. Documents 22 are separately released from the enclosure feeders 20 onto a long deck 30 and collated as the released documents (not shown) are pushed by a plurality of pusher fingers 32 driven by one or more endless belts or chains 34 toward the envelope feeder/inserter station 12. At the same time, a stack of envelopes 18 are placed on the envelope feeder 14 so that one envelope at a time is released from the envelope feeder 14 into the envelope insertion area 16 where the envelope is spread open to allow the collated documents to be stuffed into the envelope. Typically the enclosure feeders are fixedly mounted to inserting machine 10 above the deck 30. As shown, the enclosure feeder 20 has a slant tray 24 for supporting the documents 22 to be released. This type of slant tray design has a very limited capacity for stacking the documents 22, partly due to the fixed distance between adjacent enclosure feeders 20. Slant trays are widely used in envelope inserting machines, as can be seen in earlier mentioned U.S. Pat. Nos. 4,501,417 (Foster et al.), 4,753,429 (Irvine et al.) and 5,660,030 (Auerbach et al.). U.S. Pat. No. 5,120,043 (Mazullo) also discloses an enclosure feeder with a slant tray for supporting the documents. U.S. Pat. No. 4,817,368 (DePasquale et al.) discloses a mailing inserting and collating apparatus, wherein a plurality of envelope hoppers each containing a vertical stack of mailing inserts for releasing the inserts into a plurality of opened envelopes. Under each envelope hopper, a rubber kicker roller having an arcuate outer surface, along with a vacuum port, is used to retrieve the lowermost insert from the stack. The major advantage of the vertical stack is that it can support more inserts or documents to be released. The major disadvantage is that the weight of the vertical stack imposes a burden to the retrieving mechanism. The weight may cause an incomplete retrieval of inserts or a torn sheet.

Thus, it is advantageous and desirable to provide a method and apparatus for reducing the burden in retrieving a lowermost sheet from a vertical stack of sheets due to the weight of the stack.

SUMMARY OF THE INVENTION

It is the primary object of the present invention to reduce the burden in retrieving a lowermost sheet from a vertical stack of sheets in a sheet feeder or the like. In particular, the burden is mostly due to the weight of the stack.

Accordingly, the first aspect of the present invention is a method of reducing the burden in retrieving sheets from the bottom of a stack of sheets of material in a sheet feeder, wherein the stack has a downward vertical force associated with gravity and the burden is related to the downward vertical force, and wherein the stack has a first side and an opposing second side, and the stack is caused to move downward toward the bottom due to the retrieving. The method comprises the steps of providing a first counteracting surface in the lower portion of the stack protruding into the first side of the stack for pushing the sheets in a first portion of the stack toward the second side, and providing a second counteracting surface on the second side below the first counteracting surface for pushing the sheets in a second portion of the stack below the first portion of the stack toward the first side, wherein the first counteracting surface provides a first counteracting force resisting the downward movement of the stack on the first side and the second counteracting surface provides a second counteracting force resisting the downward movement of the stack on the second side, and wherein the first reaction force and the second reaction force comprise upward vertical components for partially countering the downward vertical force.

Preferably, the first counteracting surface comprises a convex surface.

Preferably, the convex surface is part of a circumference of a roller, which is caused to turn by the downward movement of the stack on the first side.

Preferably, the second counteracting surface comprises a further convex surface.

It is possible that the further convex surface is part of a circumference of another roller.

It is also possible that the further convex surface is part of a large surface, which includes a concave section.

The second aspect of the present invention is an apparatus for reducing burden in retrieving sheets from bottom of a stack of sheets in a sheet feeder, wherein the stack has a downward vertical force associated with gravity and the burden is related to the downward vertical force, and wherein the stack has a first side and an opposing second side, and the stack is caused to move downward toward the bottom due to the retrieving. The apparatus comprises a first counteracting surface in the lower portion of the stack protruding into the first side of the stack for pushing the sheets in a first portion of the stack toward the second side, and a second counteracting surface on the second side below the first counteracting surface for pushing the sheets in a second portion of the stack below the first portion of the stack toward the first side, wherein the first counteracting surface provides a first counteracting force resisting the downward movement of the stack on the first side and the second counteracting surface provides a second counteracting force resisting the downward movement of the stack on the second side, and wherein the first reaction force and the second reaction force comprise upward vertical components for partially countering the downward vertical force.

The third aspect of the present invention is a sheet feeder for feeding a substantially vertical stack of sheets, wherein the stack has a bottom, a first side and an opposing second side. The sheet feeder comprises a retrieving mechanism for retrieving sheets from the bottom of the stack; a first counteracting surface in the lower portion of the stack protruding into the first side of the stack for pushing the sheets in a first portion of the stack toward the second side; and a second counteracting surface on the second side below the first counteracting surface for pushing the sheets in a second portion of the stack below the first portion of the stack toward the first side, wherein the stack is caused to move downward toward the bottom due to the retrieving, and the first counteracting surface provides a first countering acting force resisting the downward movement of the stack on the first side and the second counteracting surface provides a second countering action force resisting the downward movement of the stack on the second side results in a second reaction force from the second counteracting surface, and wherein the first counteracting force and the second counteracting force comprise upward vertical components for partially countering a downward vertical force associated with the weight of the stack.

The present invention will become apparent upon reading the description taken in conjunction with FIGS. 2 to 5*b*.

DETAILED DESCRIPTION

It has been observed that it is usually not possible to support a single thin sheet of paper at its edges when the beam strength of the sheet is insufficient to support the weight of the paper. Similarly, it is usually not possible to support a thin stack of thin paper because the stack would sag, causing the sheets to slip off their support. However, when a sufficient quantity of paper is supported by two edges, the stack will be supported as a beam. A plausible explanation for this observed fact is that the internal friction of the stack, generated by the sheet-to-sheet friction, propagates gradually across the sheet to support the uppermost sheets of the stack with even pressure. This demonstrates that a small point support of a stack of sheets at two sides thereof can be used to support a full stack. Therefore, it is plausible to introduce a plurality of small-point supporting members into the path of a downward moving stack of sheets in a sheet feeder to reduce the burden of a sheet retriever that is used to retrieve sheets from the bottom of the stack.

When attempting to impede the flow of a stack moving by the force of gravity, the supporting members must simultaneously hinder and allow movement of the fed material. Because of this requirement, the supporting members can be provided at different portion of the stack and allow the sheets to move by. This requirement can be met by the sheet feeder, as shown in FIGS. 2, 4*a* to 5*b*.

Figure 1:
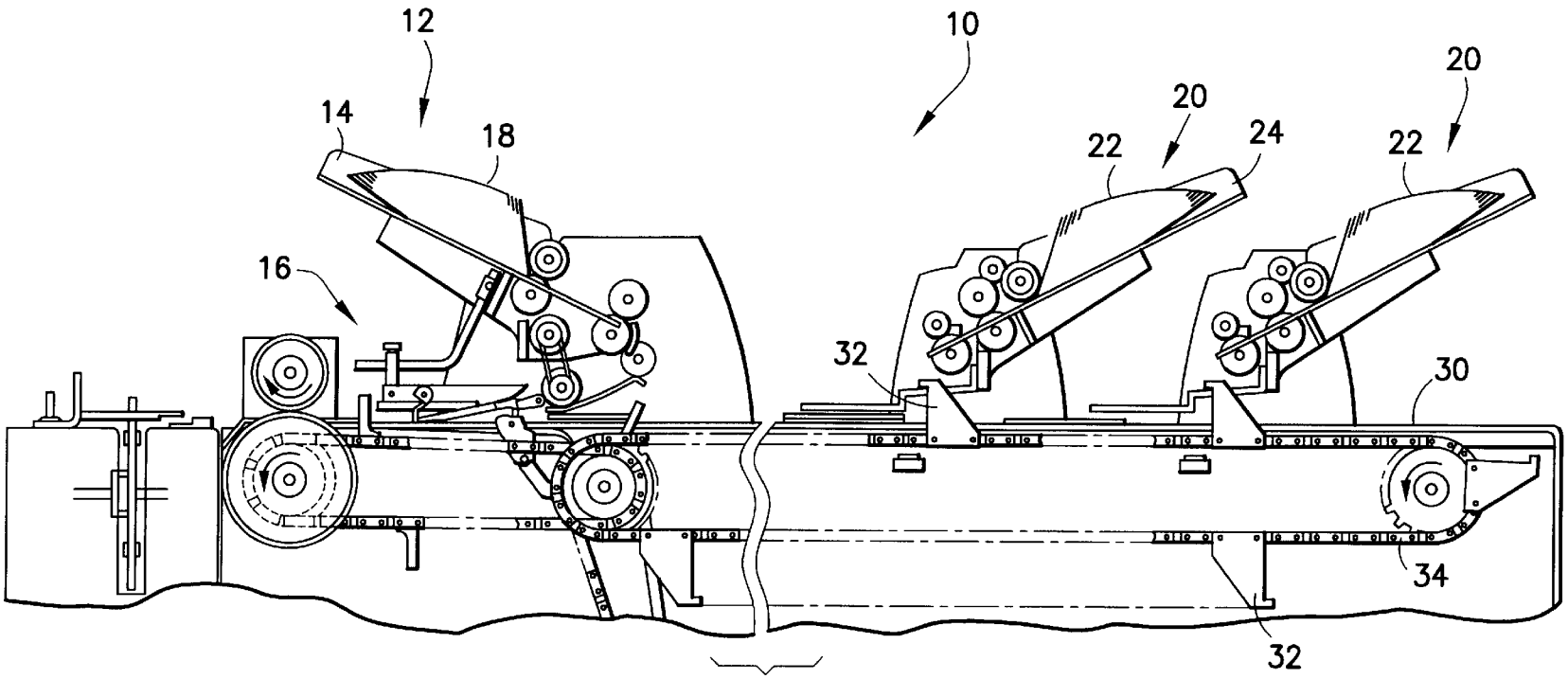
FIG. 1 PRIOR ART
FIG. 1 is a diagrammatic representation illustrating a prior art envelope inserting machine for mass mailing.
Figure 2:
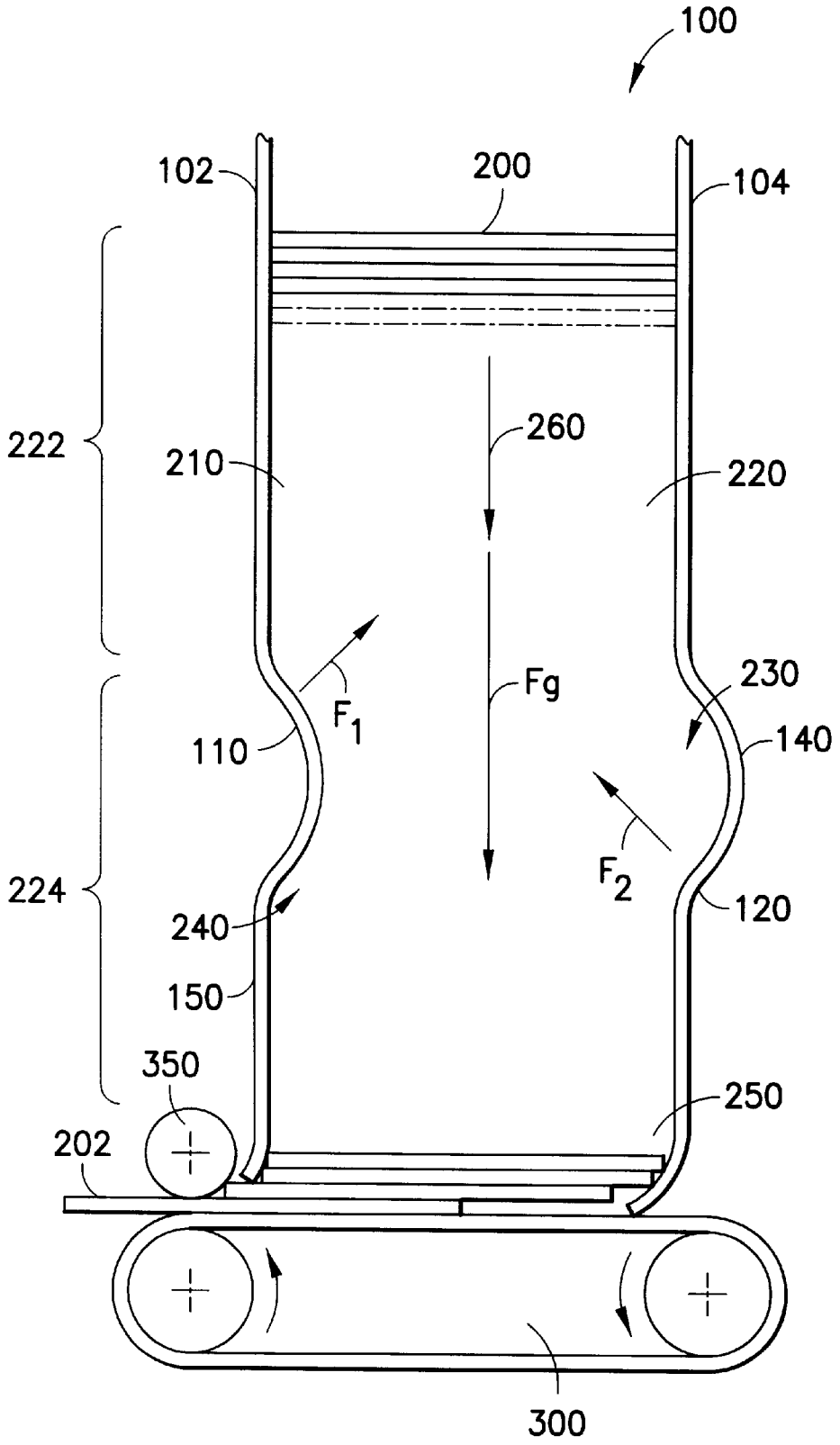
FIG. 2 is a diagrammatic representation of a sheet feeder, illustrating the burden reduction principle, according to the present invention.

Referring to FIG. 2, a sheet feeder 100 has a first wall 102 and an opposing second wall 104 to contain a stack of sheets 200 having a first side 210 and a second side 220. A retrieving mechanism 300, together with a separation mechanism 350 (such as a fixed roller, an idler roller, a nip, a wedge and the like), is used to retrieve a sheet 202 from the bottom section 250 of the stack 200. Because the sheets 202 are constantly retrieved from the bottom section 250, there is a downward movement, as denoted by arrow 260, of the stack 200 related to the retrieving. The weight of the stack 200 imposes a burden, as denoted by a downward force $F_g$, to the retrieving mechanism 300. In order to reduce the burden on the retrieving mechanism 300 due to this gravity-related force, small-point supporting members are provided on the first side 210 and the second side 220 of the stack 200 for hindering the downward movement of the stack 200. As shown in FIG. 2, a first convex surface 110 is provided on the first side 210 of the stack 200 and a second convex surface 120 is provided on the second side 220. In order to allow the downward movement of the stack 200, a concave surface 140 conforms to the shape of the first convex surface 110 so that the first convex surface 110 can push the sheets in a first portion 230 of the stack 200 toward the second side 220. The hindrance to the downward movement of the stack 200 on the first side 210 by the first convex surface 110 results in a first counteracting force $F_1$, as shown in FIG. 2. Likewise, the hindrance to the downward movement of the stack 200 on the second side 220 by the second convex surface 120 results in a second counteracting force $F_2$. In order to allow the downward movement of the stack 200 below the first portion 230, the section 150 of the wall 102 conforming to the shape of the convex surface 120 is provided so that the sheets in the second portion 240 below the first portion 230 can be pushed back toward the first side 102.

Figure 3A:
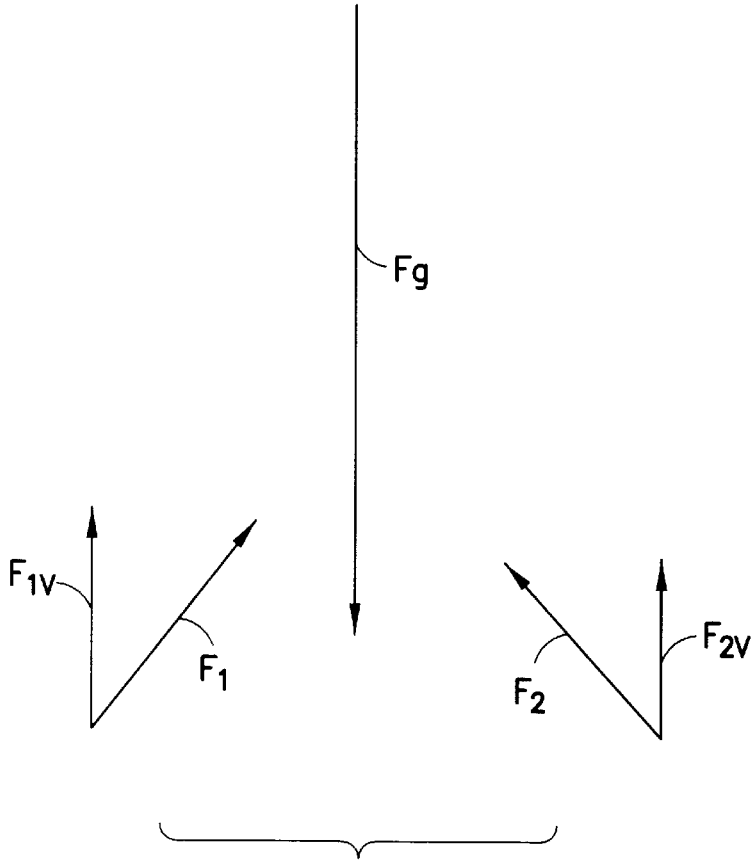
FIG. 3*a* is a vector diagram illustrating the force and counteracting forces in the sheet feeder, according to the present invention.
Figure 3B:
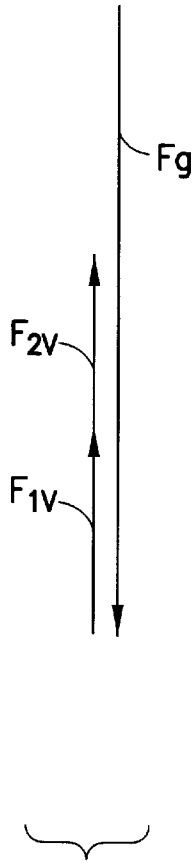
FIG. 3*b* is a vector diagram illustrating the net force acting on the sheet retrieving mechanism in the sheet feeder, according to the present invention.

The first counteracting force $F_1$ has an upward, vertical component $F_{1V}$, and the second counteracting force $F_2$ has an upward, vertical component $F_{2V}$, as shown in FIG. 3*a*. Together, these vertical components counter a part of the downward force $F_g$, as shown in FIG. 3*b*, thereby reducing the torque required to retrieve a sheet 202 from the bottom of the stack 200 by the retrieving mechanism 300 (FIG. 2).

It should be noted that the reduction in the downward force $F_g$ by the counteracting surfaces 110 and 120 depends on the location of these surfaces. It is preferable to locate both the first and second surfaces in the lower portion 224 of the stack 200, as shown in FIG. 2. As shown in FIG. 2, the upper portion of the stack 200 is denoted by reference numeral 222.

Figure 4A:
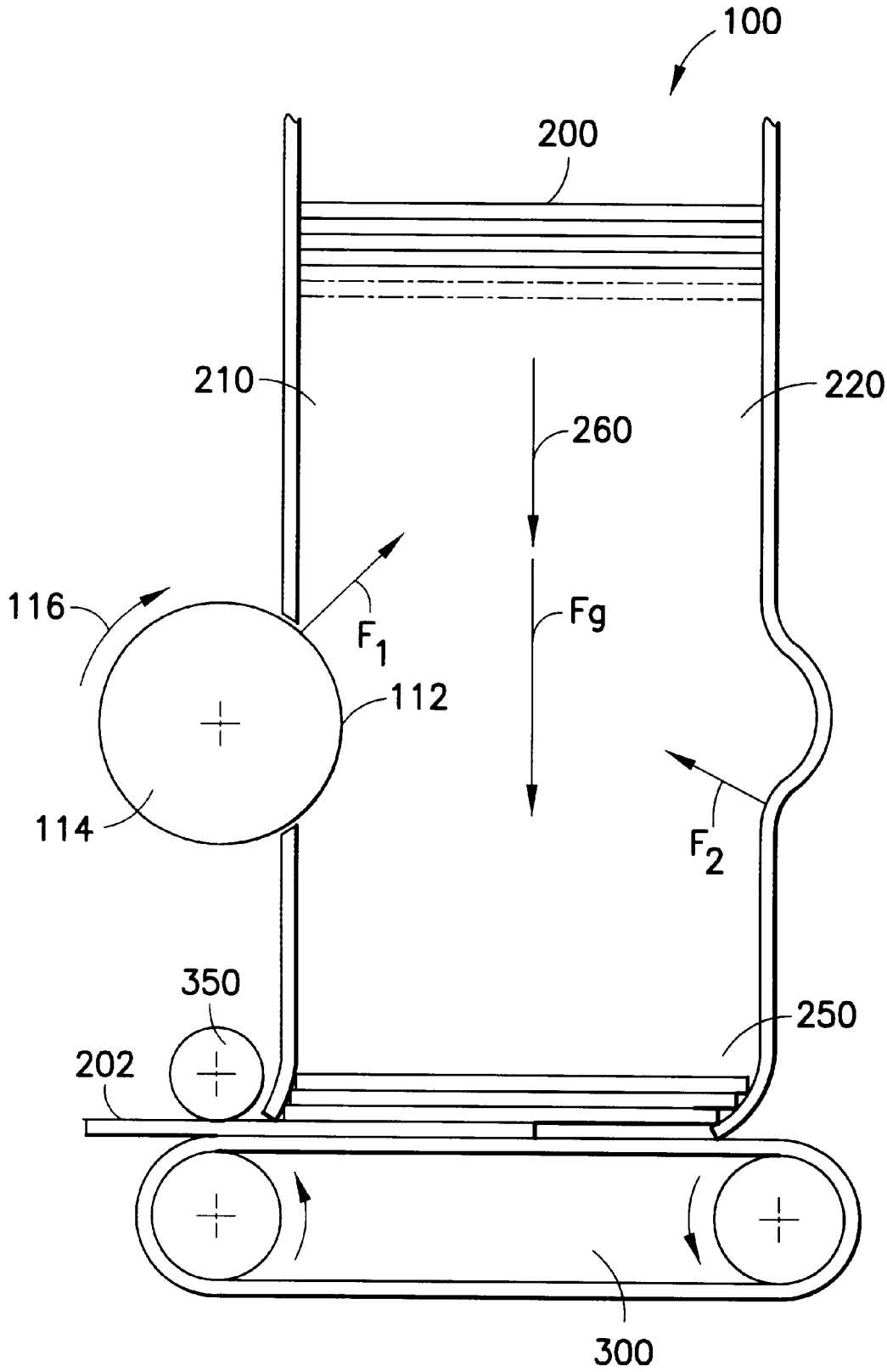
FIG. 4*a* is a diagrammatic representation illustrating the preferred embodiment of the present invention.

In the preferred embodiment of the present invention, as shown in FIG. 4*a*, the first counteracting surface 110 (FIG.

2) can be a part of the circumference 112 of a wheel, cylindrical element or roller 114. The downward movement of the stack 200, as noted by arrow 260, causes the roller 114 to turn in a clockwise direction, as denoted by arrow 116. This clockwise motion helps to prevent the sheets in the first portion 230 of the stack 200 from being stuck by the first counteracting surface.

Figure 4B:
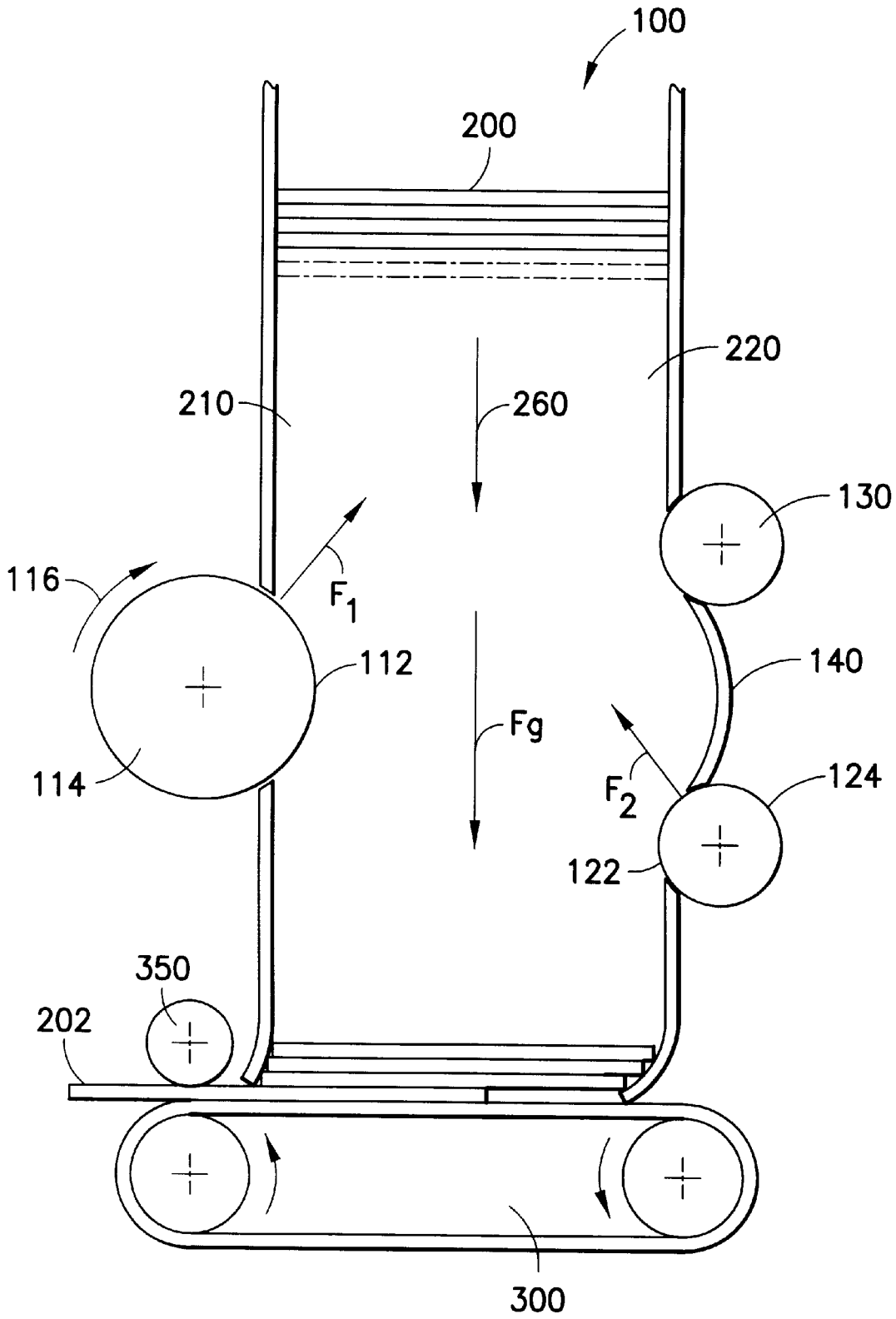
FIG. 4*b* is a diagrammatic representation illustrating an alternative embodiment of the present invention.
Figure 4C:
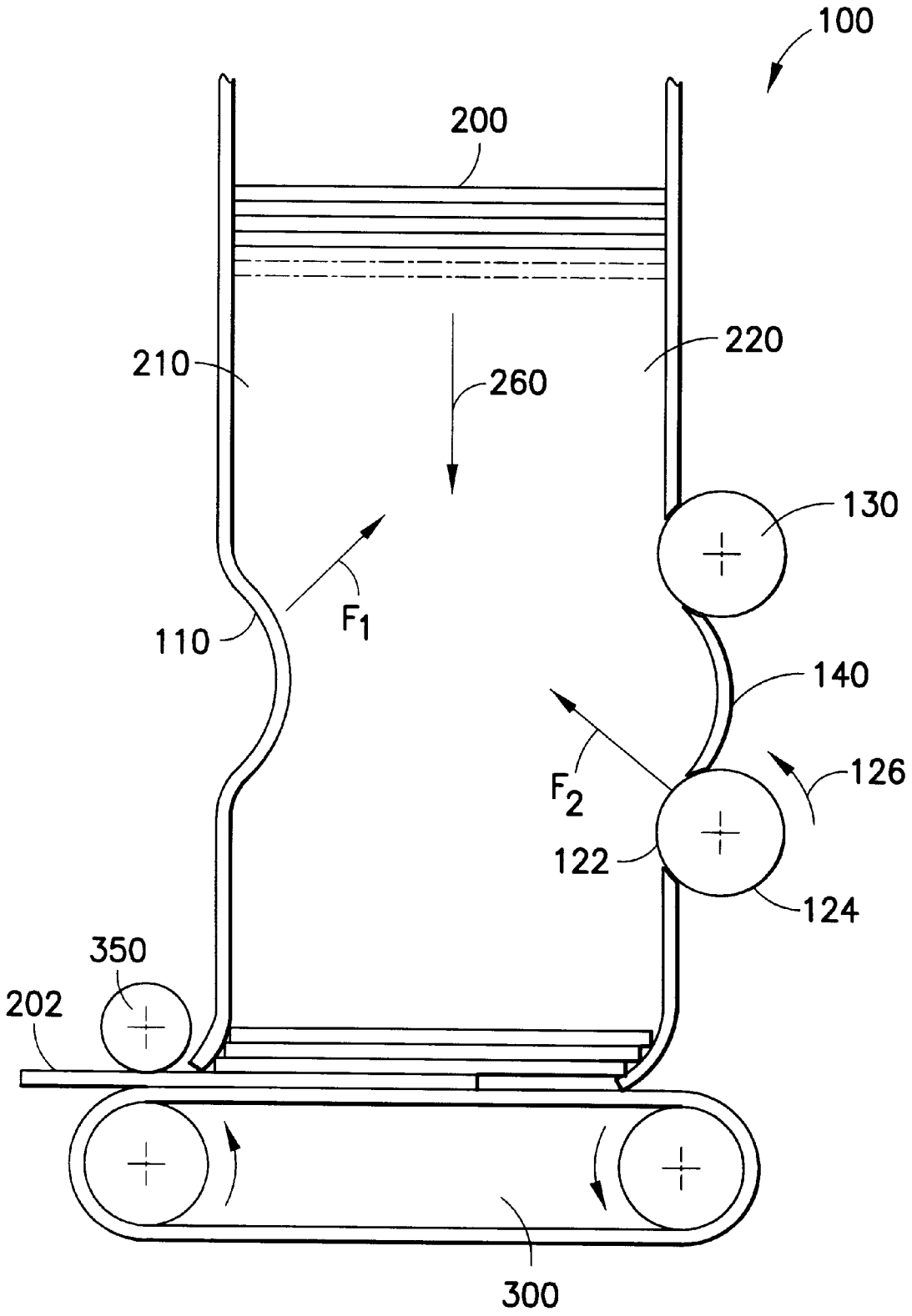
FIG. 4*c* is a diagrammatic representation illustrating yet another embodiment of the present invention.

The second counteracting surface 120 (FIG. 2) can also be a part of the circumference 122 of another wheel, cylindrical element or roller 124, as shown in FIG. 4*b*. The downward movement of the stack 200, as noted by arrow 260, causes the roller 124 to turn in a clockwise direction, as denoted by arrow 126. This clockwise motion helps to prevent the sheets in the second portion 240 of the stack 200 from being stuck by the second counteracting surface. It is also possible to install another wheel or roller 130 above the concave surface 140 on the second side 202 of the stack 200 to help the downward movement of the stack 200. Alternatively, the rollers 130 and 124 are used on the second side 220 of the stack 200, but the roller 114 is not used on the first side wall 210, as shown in FIG. 4*c*.

Figure 5A:
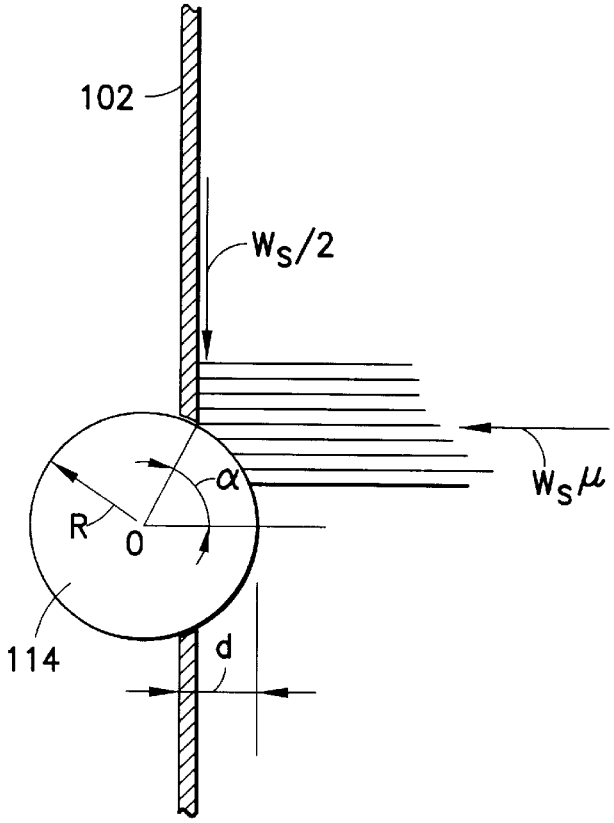
FIG. 5*a* is a diagrammatic representation illustrating the protrusion of the first countering surface into the first side of the stack.
Figure 5B:
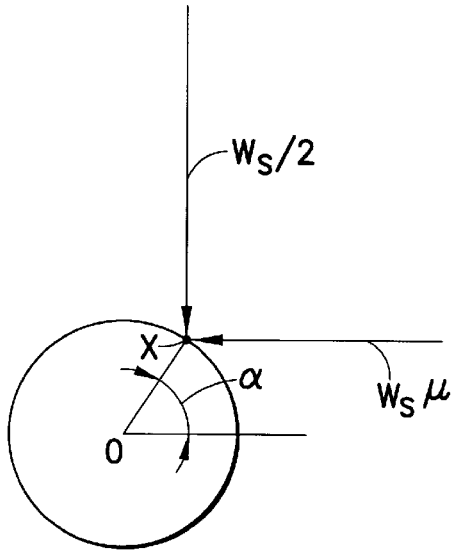
FIG. 5*b* is a vector diagram illustrating various forces acting on the first counteracting surface.

It has been found that the protrusion of the first counteracting surface 110 or the circumference 112 of the roller 114 into the first side 210 of the stack 200 depends upon many factors. For example, it depends on the stiffness of the sheets, the size of the sheets, the stack height and the friction between sheets. However, the protrusion distance of the first convex surface 110 into the first side 210 of the stack 200 can be estimated as follows. As shown in FIG. 5*a*, the roller 114 has a radius R and protrudes into the first side 210 by a distance equal to R(1-cosα). Because the stack 200 is supported by both the first counteracting surface 110 on the first side 210 and the second counteracting surface 120 on the second side 220 (FIG. 2), it can be assumed that the roller 114 is responsible for roughly half the reduction in the downward force $F_g$ (FIG. 3*b*). The actual reduction is a function of angle and friction. For simplicity, however, it can be assumed that the roller 114 roughly carries half of the stack weight, or $W_s/2$, where $W_s$ is the weight of the stack above the counteracting surfaces 110 and 120. Accordingly, the weight of the stack below the counteracting surfaces 110 and 120 is not carried by these counteracting surfaces. Thus, it would be advantageous to position the first and second counteracting surfaces in the lower portion of the stack 200. As shown in FIG. 5*a*, the force acting on the roller 114 is assumed to be located along the first wall 102 of the feeder 100. In addition to the stack weight, the frictional force acting on the roller 114 is assumed to be $W_s\mu$ where $\mu$ is the frictional force coefficient. The vector diagram of the forces acting on the roller 114 are shown in FIG. 5*b*. Summing the moments around the center O of the roller 114 at point X, we obtain:

$$W_s\mu \sin \alpha-(W_s/2)\cos \alpha=0$$

or $$\tan \beta=(\tfrac{1}{2}\mu)$$

Assuming that $\mu$=0.52, we have α=43.88 degrees. For a stack of sheets 17 inches (43.2 cm) high and each sheet measures 3.81"×8.5"×0.004" (9.68 cm×21.6 cm×0.01 cm) and a roller with a radius of 47 mm is used, the protrusion distance d is given by $$\begin{aligned} d &= R - R\cos\alpha \\ &= 47(1 - 0.721) \\ &= 13.1 \text{ mm.} \end{aligned}$$

The present invention has been described in conjunction with FIG. 2 to FIG. 4*c*, wherein the stack is illustrated as a vertical stack. It should be noted that the stack can be tilted away from the vertical position. As shown in the FIG. 2 to FIG. 4*c*, there is only one supporting surface (i.e. counteracting surface) on each side of the stack. However, it is possible to implement two or more supporting surfaces on each side of the stack. Also, it is possible to use supporting surfaces on the third and fourth sides of the stack. Furthermore, the same principle can be applied to an envelope feeder. Therefore, the word "sheet", as used herein, is used in a broader context to include any flat item, such as an envelope, or a folded piece.

The first and second counteracting surfaces have been described hereinabove as convex surfaces. It should be understood that these surfaces can be of many different shapes and forms. They can be flat, partly convex and partly concave or flat, or partly flat and partly concave. They can be oriented in different directions, relative to the downward force.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method of reducing a burden in retrieving sheets of material from a bottom of a stack of sheets in a sheet feeder, wherein the stack has a downward vertical force associated with gravity and the burden is related to said downward vertical force, and wherein the stack has a first side and an opposing second side, and the stack is caused to move downward toward the bottom due to said retrieving, said method comprising the steps of:

providing a first counteracting surface protruding into the first side of the stack for pushing the sheets in a first portion of the stack toward the second side; and providing a second counteracting surface on the second side below the first counteracting surface for pushing the sheets in a second portion of the stack below the first portion of the stack toward the first side, wherein the first counteracting surface provides a first counteracting force resisting the downward movement of the stack on the first side and the second counteracting surface provides a second counteracting force resisting the downward movement of the stack on the second side, and wherein the first counteracting force and the second counteracting force comprise upward vertical components for partially countering the downward vertical force;

wherein the first counteracting surface comprises an idler roller, which is caused to turn by the downward movement of the stack on the first side.

2. The method of claim 1, wherein the stack is substantially a vertical stack.

3. The method of claim 1 further including the step of estimating a distance for protruding the first counteracting surface into the first side of the stack, where the distance is calculated based on balancing a first moment acting on the idler roller from the downward vertical force with a second moment acting on the idler roller from a friction force resisting pushing the sheets in the first portion of the stack toward the second side.

4. The method of claim 1, wherein the second counteracting surface element comprises a second idler roller, which is caused to turn by the downward movement of the stack on the second side.

5. An apparatus for reducing a burden in retrieving sheets of material from a bottom of a stack of sheets in a sheet feeder, wherein the stack has a downward vertical force associated with gravity and the burden is related to said downward vertical force, and wherein the stack has a first side and an opposing second side, and the stack is caused to move downward toward the bottom due to said retrieving, said apparatus comprising:

a first counteracting surface protruding into the first side of the stack for pushing the sheets in a first portion of the stack toward the second side; and a second counteracting surface on the second side below the first counteracting surface for pushing the sheets in a second portion of the stack below the first portion of the stack toward the first side, wherein the first counteracting surface provides a first counteracting force resisting the downward movement of the stack on the first side and the second counteracting surface provides a second counteracting force resisting the downward movement of the stack on the second side, and wherein the first counteracting force and the second counteracting force comprise upward vertical components for partially countering the downward vertical force;

wherein the first counteracting surface comprises an idler roller, which is caused to turn by the downward movement of the stack on the first side.

6. The apparatus of claim 5, wherein the stack is substantially a vertical stack.

7. The apparatus of claim 5 wherein the first counteracting surface protrudes into the first side of the stack by an approximate distance to balance a first moment acting on the idler roller from the downward vertical force with a second moment acting on the idler roller from a friction force resisting pushing the sheets in the first portion of the stack toward the second side.

8. The apparatus of claim 5, wherein the second counteracting surface comprises a second idler roller, which is caused to turn by the downward movement of the stack on the second side.

9. A sheet feeder for feeding a stack of sheets, wherein the stack has a bottom, a first hide and an opposing second side, said sheet feeder comprising;

a first wall for supporting the first side of the stack;

a second wall opposing the first wall for supporting the second side of the stack;

a retrieving mechanism for retrieving sheets from the bottom of the stack;

a first counteracting surface protruding into the first side of the stack for pushing the sheets in a first portion of the stack toward the second side; and a second counteracting surface on the second side for pushing the sheets in a second portion of the stack below the first portion toward the first side, wherein the first counteracting surface provides a first counteracting force resisting the downward movement of the stack on the first side and the second counteracting surface provides a second counteracting force resisting the downward movement of the stack on the second side, and wherein the first reaction force and the second reaction force comprise upward vertical components for partially countering the downward vertical force;

wherein the first counteracting surface comprises an idler roller, which is caused to turn by the downward movement of the stack on the first side.

10. The sheet feeder of claim 9, wherein the stack is a substantially vertical stack.

11. The apparatus of claim 9 wherein the first counteracting surface protrudes into the first side of the stack by an approximate distance to balance a first moment acting on the idler roller from the downward vertical force with a second moment acting on the idler roller from a friction force resisting pushing the sheets in the first portion of the stack toward the second side.

12. The sheet feeder of claim 9, wherein the second counteracting surface comprises a second idler roller, which is caused to turn by the downward movement of the stack on the second side.

* * * * *